US011846080B2

(12) United States Patent
Jäger et al.

(10) Patent No.: US 11,846,080 B2
(45) Date of Patent: Dec. 19, 2023

(54) HOSE ARRANGEMENT FOR CREATING A BUBBLE CURTAIN IN BODIES OF WATER

(71) Applicant: ARNOLD JÄGER HOLDING GMBH, Hannover (DE)

(72) Inventors: Sebastian Jäger, Hannover (DE); Aaron Stoffers, Porta Westfalica (DE); Franz Tekbas, Osnabrück (DE)

(73) Assignee: ARNOLD JÄGER HOLDING GMBH, Hannover (DE)

( * ) Notice: Subject to any disclaimer, the term of this patent is extended or adjusted under 35 U.S.C. 154(b) by 0 days.

(21) Appl. No.: 17/893,474

(22) Filed: Aug. 23, 2022

(65) Prior Publication Data

US 2023/0059977 A1 Feb. 23, 2023

(30) Foreign Application Priority Data

Aug. 23, 2021 (EP) ..... 21192607

(51) Int. Cl.
*E02D 13/00* (2006.01)
*B05B 1/20* (2006.01)
*G10K 11/16* (2006.01)

(52) U.S. Cl.
CPC ..... *E02D 13/005* (2013.01); *B05B 1/207* (2013.01); *G10K 11/161* (2013.01)

(58) Field of Classification Search
CPC ..... E02D 13/005; B05B 1/207; G10K 11/161
See application file for complete search history.

(56) References Cited

FOREIGN PATENT DOCUMENTS

| | | | | |
|---|---|---|---|---|
| CN | 110670591 A * | 1/2020 | | |
| DE | 102010048474 A1 * | 4/2012 | ..... | E02D 13/00 |
| DE | 202014005397 U1 | 9/2014 | | |
| DE | 102017104457 A1 | 9/2018 | | |
| EP | 2431531 A1 | 3/2012 | | |
| EP | 2631368 A2 * | 8/2013 | ..... | E02D 13/005 |
| WO | WO-2014045231 A2 * | 3/2014 | ..... | E02D 27/52 |

OTHER PUBLICATIONS

European Search Report for EP21192607 dated Jan. 11, 2022, 1 page.

* cited by examiner

*Primary Examiner* — Jeremy A Luks
(74) *Attorney, Agent, or Firm* — BARNES & THORNBURG LLP

(57) ABSTRACT

The present invention relates to a hose arrangement for creating a bubble curtain in bodies of water, comprising at least one air hose including an interior space enclosed by a wall, where a perforation consisting of individual punctures is introduced in the wall at least in an upper, first circumferential area, from which air can be discharged, when the interior space is pressurized, for creating a bubble curtain extending in the longitudinal direction of the air hose, and a ballast receptacle including a receiving area extending in the longitudinal direction, in which an elongated ballast element is received.

20 Claims, 6 Drawing Sheets

HOSE ARRANGEMENT FOR CREATING A BUBBLE CURTAIN IN BODIES OF WATER

Figure 1:
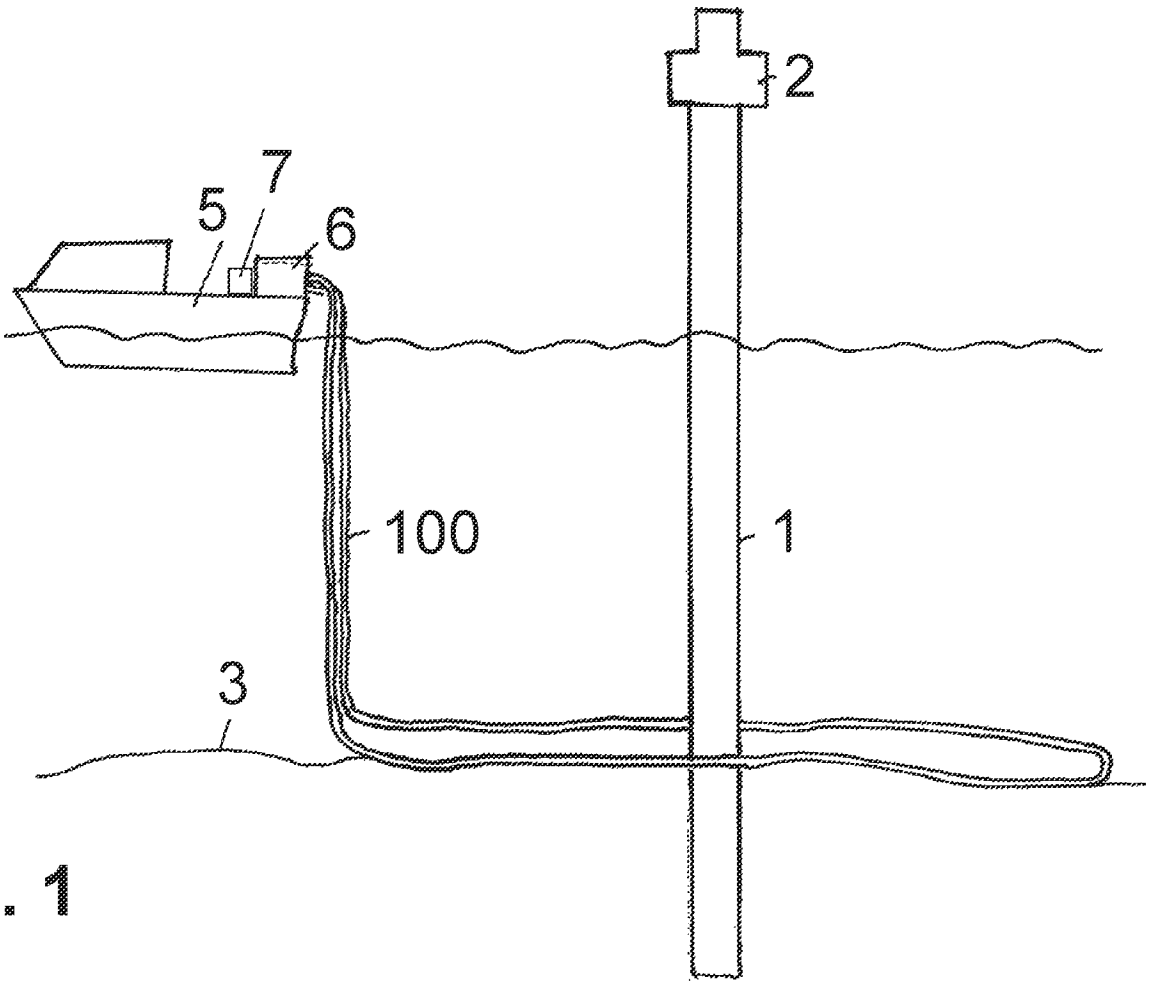

This patent application claims priority to European Patent Application No. 21192607.6, filed Aug. 23, 2021, the disclosure of which is incorporated herein by reference in its entirety.

The present invention relates to a hose arrangement for creating a bubble curtain in bodies of water according to the preamble of claim 1.

A hose arrangement of this type is utilized, in particular, as a noise barrier upon hammering a pole into the bottom of a body of water. Using such a hose arrangement a so-called large bubble curtain is created. To that end, an air hose is deployed around the construction site and affixed to the bottom of the body of water, the air hose is supplied with pressurized air via at least one compressor, the air hose being equipped with a plurality of holes or punctures across its length. The pressurized air will leak through the punctures thereby creating a bubble curtain rising up from the air hose. This bubble curtain of air bubbles forms a physically-acoustically absorbing barrier for the sound waves occurring during hammering. The primary purpose of the bubble curtain is to protect marine mammals with sensitive hearing such as porpoises and seals from hearing damage.

While, in the early stages of development of the large bubble curtain system, the air hoses still had to be affixed by divers at the bottom of the body of water and, following conclusion of the hammering works, were either given up and left at the bottom of the body of water or had to be removed by divers again, nowadays the air hoses are positioned by means of a pipe-laying vessel. On these ships the air hose is wound up or reeled respectively on a winch from which the air hose is wound off via the stern of the ship and placed onto the bottom of the body of water in the shape of a ring around the construction site. In an embodiment known in the art, metal sleeves are arranged at the air hose at certain distances across the entire length of the air hose which are interconnected via a chain. The sleeves and the chain serve, on the one hand, as ballast so that the air hose filled with air in operation stays at or, respectively, remains affixed to the bottom of the body of water, and, on the other, may function as tension member for absorbing the tension forces occurring upon pipe-laying and recovering the lines.

The above-described state of the art wherein sleeves and chains are utilized as ballast bears the disadvantage that the chain may impede the introducing and recovering of the air hose in the body of water. Moreover, the sleeves in contact with the air hose may lead to damage of the air hose by scrubbing and bending. Further, the hoses, sometimes reinforced by steel mesh inlays or similar, can only be drilled conventionally, strongly limiting the variability of the holes or, respectively, slits introduced therein.

In the document DE 20 2013 100 564 U1 a hose arrangement is described, wherein, in one embodiment, an air hose is utilized which is made from a rubber or a polymer. To increase tensional strength and compressive strength the air hose is provide with a fabric layer or, respectively, mesh wire inlay. The wall of the air hose comprises a plurality of bores or holes respectively. These have a diameter of about 0.5 to about 5 mm and are spaced apart from one another by about 100 cm to about 10 cm. To prevent buoyancy of the air-filled hose in water a weight element is introduced in the air hose in the form of a chain. In contrast to a chain arranged on the outside the chain arranged within the air hose does not impede the winding properties of the air hose so that great lengths of the air hose can be placed on a winding device.

However, the chain arranged within the air hose impedes the air flow within the air hose and facilitates water entering through the bores in the wall when the pressurized air flow is switched off.

In the printed publications addressing this type of apparatus, WO 2014 045 231 A2 and WO 2018/157884 A1, this disadvantage is overcome in that the air hose is connected to a ballast receptacle in a connecting region below a lower crown area and the weight element is received in this ballast receptacle whereby the air flow in the air hose is no longer impeded and it is possible to wind up and hold the hose arrangement at the bottom of the body of water.

In all aforementioned embodiments the air hose is usually made of rubber or other polymer materials and the wall is reinforced by at least one additional fabric layer to make the air hose more pressure stable and, most of all, to guarantee sufficient tensile strength to avoid damage to the air hose caused by tension forces occurring in operation. An air hose of this type must then be processed accordingly by mechanical or chemical or thermal means in order to connect it to the ballast hose, and this requires an additional processing step potentially damaging the air hose or at least impeding the discharging of air bubbles.

The citation DE 20 2014 005 397 U1 describes a further option of forming a bubble curtain as a noise barrier in the case of a pole to be hammered into the bottom of the sea. Hereby, the pole is surrounded by a structure, with a bubble curtain provided in the gap between the structure and the pole. The structure consists of a packet of rings interconnected by a textile fabric. The rings and the textile fabric form a hose surrounding the pole. This air hose forms a type of cage through which the current of the sea water in the gap between the hose and the pole is reduced.

It is the object of the present invention to provide a hose arrangement of this type which eliminates the disadvantages of the state of the art mentioned previously, in particular, affixes the air hose to the ballast element in a simple manner and possibly protects it well from outside forces while allowing a regular bubble curtain to be provided.

This task is solved according to the invention by a hose arrangement according to claim 1. The sub-claims specify preferred further developments.

Thus, according to the invention, a hose arrangement for creating a bubble curtain in bodies of water is provided, wherein the air hose is jacketed, preferably across its entire longitudinal extension or length respectively or at least across 75% of its length, by a support sheath comprising material bars and intermediate openings, the air hose being connected to the ballast receptacle via the support sheath, and preferably exclusively via this, in a connecting area, and the openings being positioned at least in the first circumferential area of the air hose to allow discharge of air from the perforation in the air hose.

Thus, an additional sheathing of a mesh type or provided with openings is provided as "connecting element" between the air hose and the ballast receptacle. By virtue of its openings this does not impede the air bubbling out of the air hose and, at the same time, can support the air hose securely in that it jackets the same thereby preventing buoyancy of the air hose when pressurized. Then, the support sheath can be connected to the ballast receptacle with lesser requirements and may even form part of it according to one embodiment without affecting the air hose itself, because the mechanical and/or thermal and/or chemical effects actions to form the connection do not affect the air hose itself because the support sheath is preferably not part of the air hose itself.

According to a first embodiment, it is provided to form the support sheath by a web of interconnected fibers, in particular, textile or mineral fibers, which form the material bars, and mesh-type openings in between. This makes for a sheathing that is simple to produce or, respectively, readily available and affordable which, by virtue of its mesh-type form is suited for receiving and supporting the air hose and, moreover, is available in various shapes and for diverse requirements, also considering its application in water.

Further, preferably, it is provided that lower ends of the web are affixed, in particular, clamped therein, to the ballast receptacle in the connecting area. This allows for a simple connection to the ballast receptacle to be made thereby simplifying the assembly process.

According to a first embodiment, it is provided that the support sheath is formed by a first partial area of a polymer band, preferably made of a fabric layer reinforced polymer, which is folded back onto itself thereby jacketing the air hose, the polymer band in the first partial area being provided with cutouts, in particular, cut out or punched out, such that openings are formed in-between material bars which, in the folded back state of the first partial area, are positioned at least in the first circumferential area of the air hose so as to allow air to be discharged from the perforation in the air hose. This provides for an alternative option for the support sheath, wherein the openings and material bars can be purposefully adapted to the application and also the dimensions of the air hose as well as of the ballast element. Hereby, it is simple to introduce the openings into a suitably cut back polymer band, for example, in a punching process, whereby various shapes of the openings are possible. In the alternative, the material bars may be later joined to the polymer band in the first partial area, for example, adhesive bonding. Thus, in this case, the first partial area of the polymer is designed in two parts.

Hereby, it may be additionally provided for the first partial area of the polymer band to essentially fully cover a second circumferential area of the air hose, the second circumferential area preferably being unperforated. Thus, in contrast to a web as support sheath, circumferential areas of the air hose not necessarily exposed may remain covered so that these are protected from damage, in particular, during transport or upon installation of the hose arrangement at the bottom of the sea.

Preferably, it is further provided for the ballast receptacle to be formed by a second partial area of the polymer band which is folded back onto itself so as to form the receiving area and receive the ballast element, the first partial area and the second partial area being designed as one piece. Thus, a one-piece design of the ballast receptacle (second partial area) as well as the support sheath (first partial area) may be provided, where the partial areas, by means of folding back onto themselves or turning respectively and by means of a subsequent joining process, form spaces or receiving areas respectively for the air hose or the ballast element respectively. Hereby, an exactly pre-configured one-piece solution can be provided which is suitable for being assembled at first at the point of destination by respective turning, thereby simplifying both transport and assembly (and even disassembly).

However, in the alternative, it may be provided for the ballast receptacle to be formed by a deformable, panel-shaped element (similar to the second partial area of the polymer band) the edge regions of which are folded loop-like back onto themselves in such a manner that a hose shape with a receiving area extending in the longitudinal direction is created, in which the ballast element is received, where the edge regions of the panel-shaped element are connected in the connecting area to the support sheath. Thus, in contrast to a one-piece solution of the second embodiment example, a two-piece solution is also conceivable which can then be combined with a web or a polymer band (comp. first partial area) as support sheath to form the hose arrangement.

Preferably, it is further provided for connector means to be arranged between the support sheath and the ballast receptacle, the connector means being designed, in particular, as a screw connection and/or a rope-type or a band-type connector means and/or nails and/or rivets and/or pilot bolts. Advantageously, these should guarantee that the ballast receptacle is connected to the respective support sheath or, respectively, that in the second embodiment example the adhesion of the hose arrangement folded back onto itself in the respective partial areas is guaranteed.

Preferably, it is further provided for the support sheath to lie fully in loose contact with the air hose or the support sheath to be connected to the air hose merely in certain areas, for example, at the ends and/or at intermediate positions, in particular, via a substance-to-substance bond, e.g., a PU adhesive, or by means of a positive-locking and/or frictional connection, for example, a clamp or a rivet connection. Hereby, it can be guaranteed that the air hose does not become twisted or distorted or shifted in the longitudinal direction in the support sheath when this is installed at the bottom of the sea, exposed to sea currents or alternates between the pressurized and the unpressurized states.

Preferably, it is further provided for the hose arrangement to comprise a plurality of air hoses, with always two air hoses adjacent one another in the longitudinal direction being connected in a sealing manner via a hose coupling. Hereby, a variable design of the hose arrangement can be attained, where the support sheath may also be continued via the hose coupling depending on the design.

Figure 2:
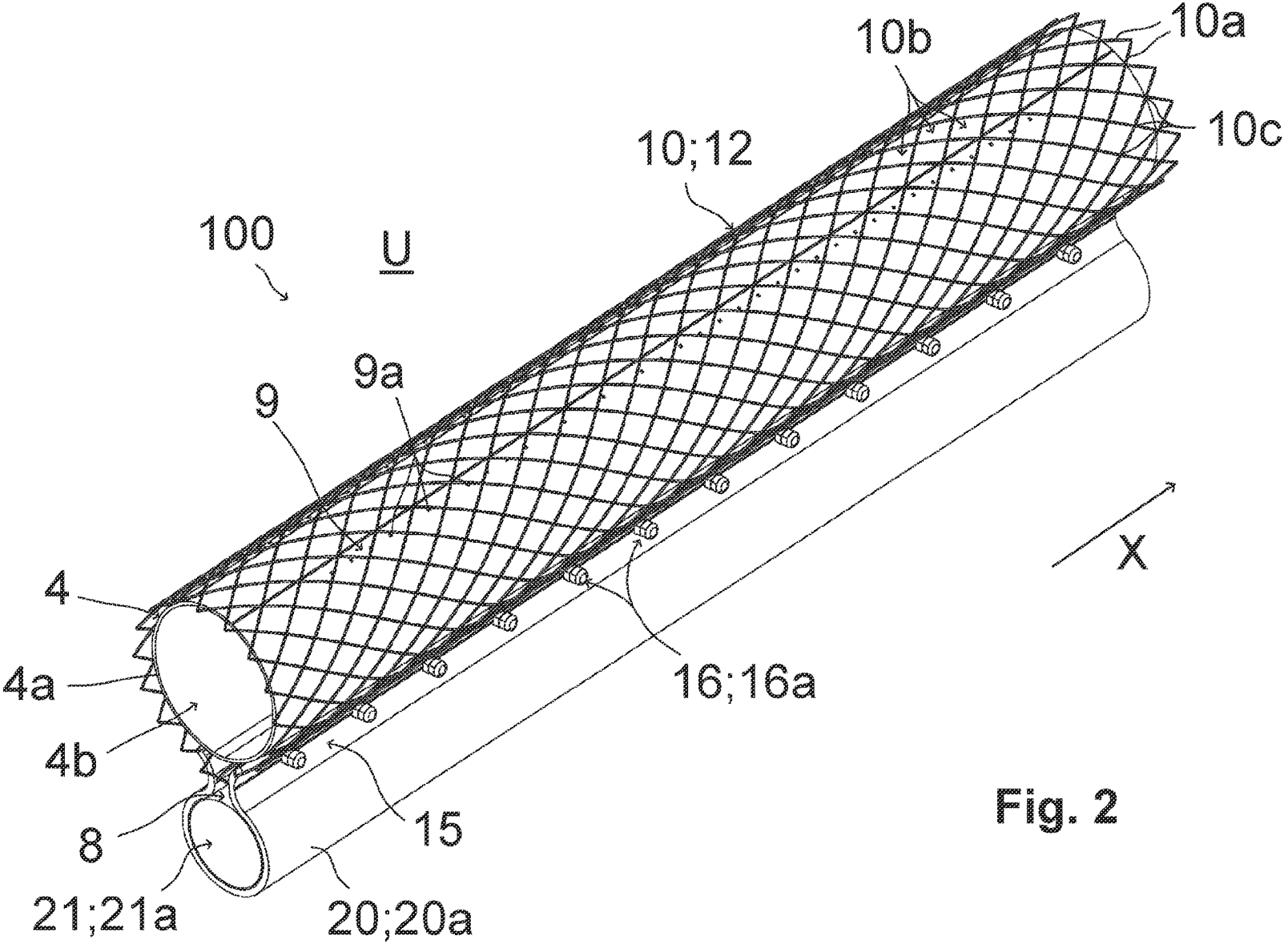
Figure 3:
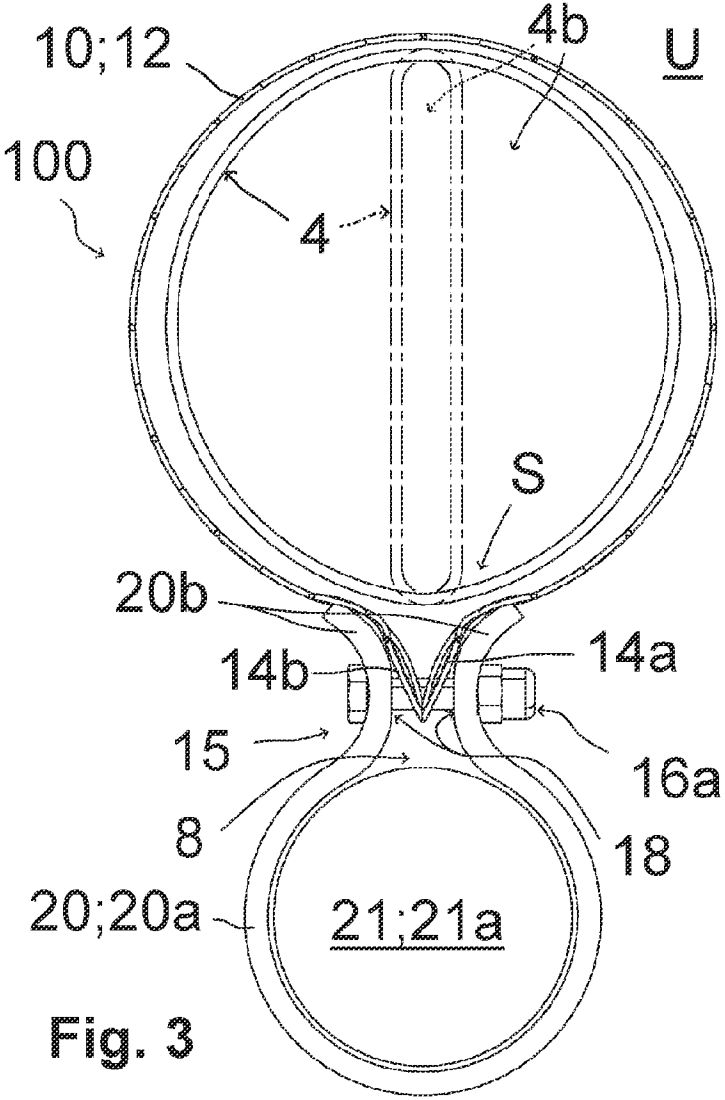
Figure 5:
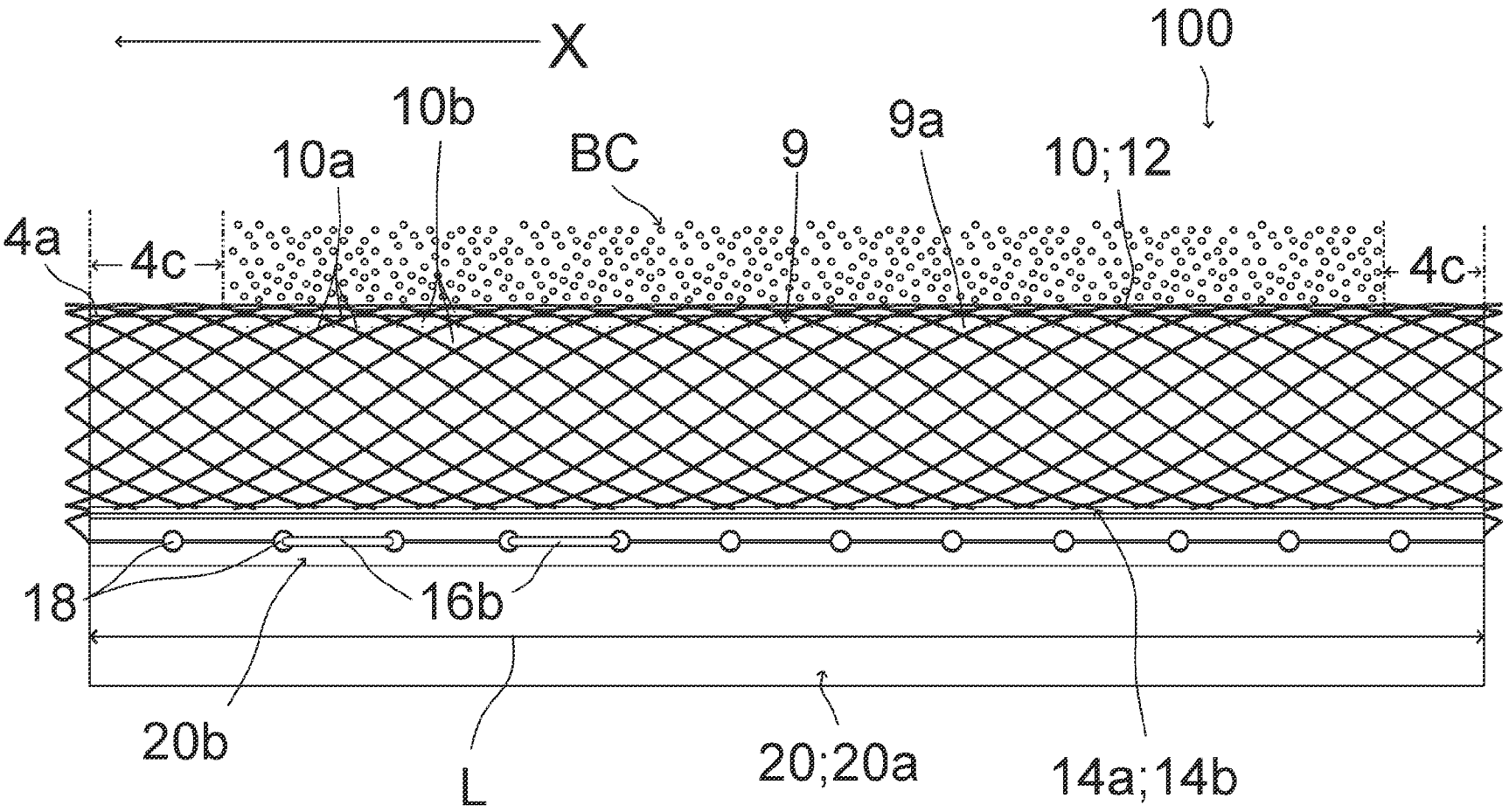
Figure 6:
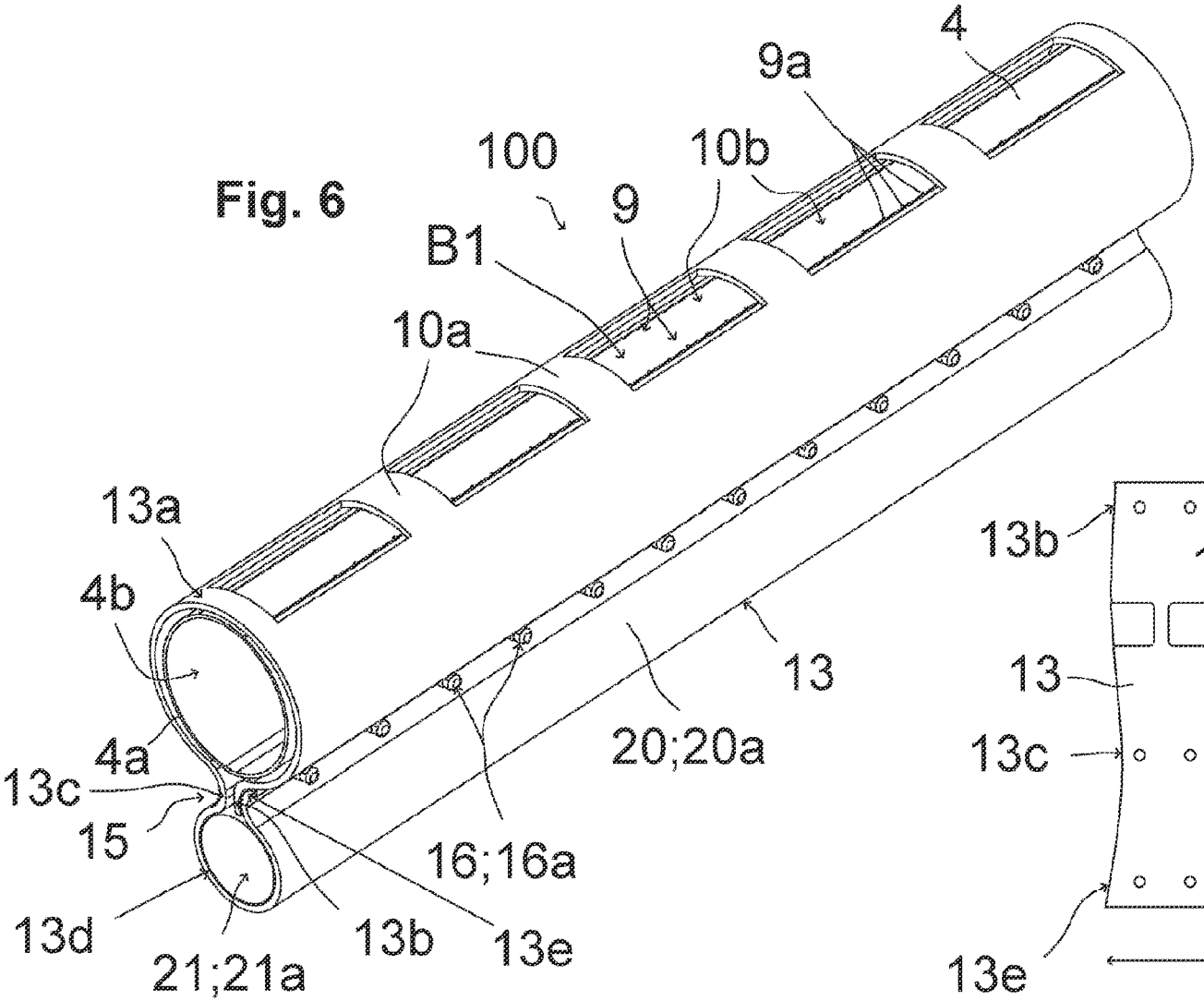
Figure 8:
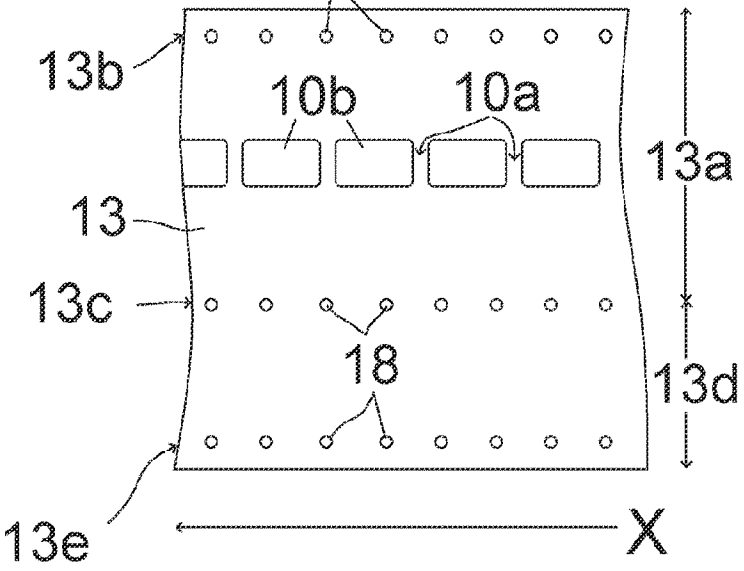

The invention is further illustrated in the following by means of embodiment examples. The accompanying drawing shows in:

FIG. 1 schematically, a hose arrangement according to the invention in operation, FIG. 2 a perspective view of the hose arrangement according to FIG. 1 in a first embodiment;

FIG. 3, 4 cross-sections through the hose arrangement according to FIG. 2;

FIG. 5 a lateral view of the hose arrangement according to FIG. 2;

FIG. 6, 7 perspective representations of a hose arrangement according to FIG. 1 in a second embodiment;

FIG. 8 a representation of the hose arrangement according to FIG. 6 rolled out flat.

When building offshore installations such as wind turbines, poles 1 or pipes are driven into the bottom of the sea 3 by means of a hammering means 2 creating a large amount of noise. Marine mammals such as porpoises may suffer damage from the sound waves transmitted underwater. In order to avoid this a bubble curtain BC (Bubble Curtain) is created during the hammering works around the pole 1 to be driven by means of which the physical characteristics of the water are changed. This breaks sound waves multiple times thereby reducing the volume.

Here, to generate the bubble curtain BC, a hose arrangement 100 comprising an air hose 4 capable of being supplied with pressurized air is placed at the bottom of the sea 3 in a ring shape around the pole 1 to be hammered in, to that end, a supply vessel 5 sails around the pole 1 in an approximately circular course, thereby winding off the hose arrangement 100 including the air hose 4 of a winding winch 6 arranged on board the supply vessel 5. On board the supply vessel 5 there is also at least one special compressor 7 utilized to press pressurized air into the air hose 4 of the hose arrangement 100. The pressurized air may be pressed in from one end of the air hose 4 or even from both ends of the air hose 4.

Figure 4:
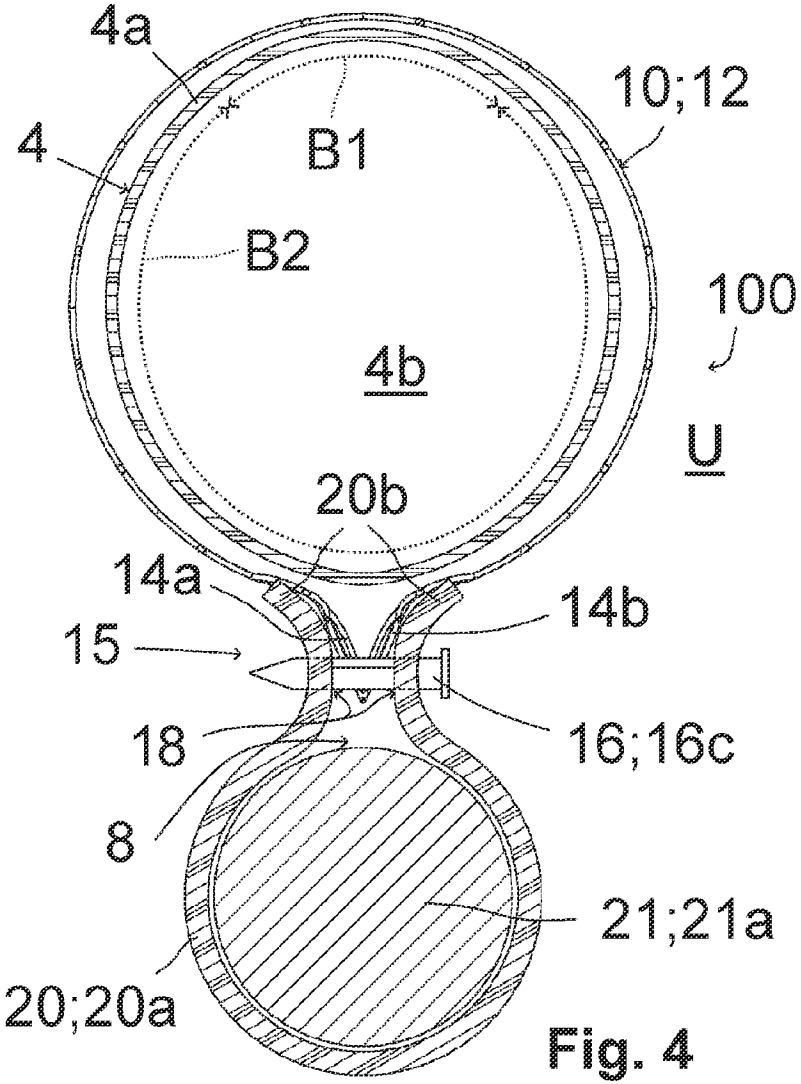

A first embodiment of the hose arrangement 100 oriented in a longitudinal direction X is shown in FIG. 2 in a perspective view and in the FIGS. 3 and 4 in a sectional view. According to this, an air hose 4 is provided having a length L (see FIG. 5) which may be, for example, between 20 m and 30 m, with a wall 4*a* made from fabric layer reinforced rubber or a comparable polymer material which is surrounded or jacketed respectively by a support sheath 10. The support sheath 10 generally consists of material bars 10*a* with openings 10*b* created in-between them so that parts of the air hose 4 are exposed so as to allow air bubbles to be discharged from the air hose 4.

Figure 7:
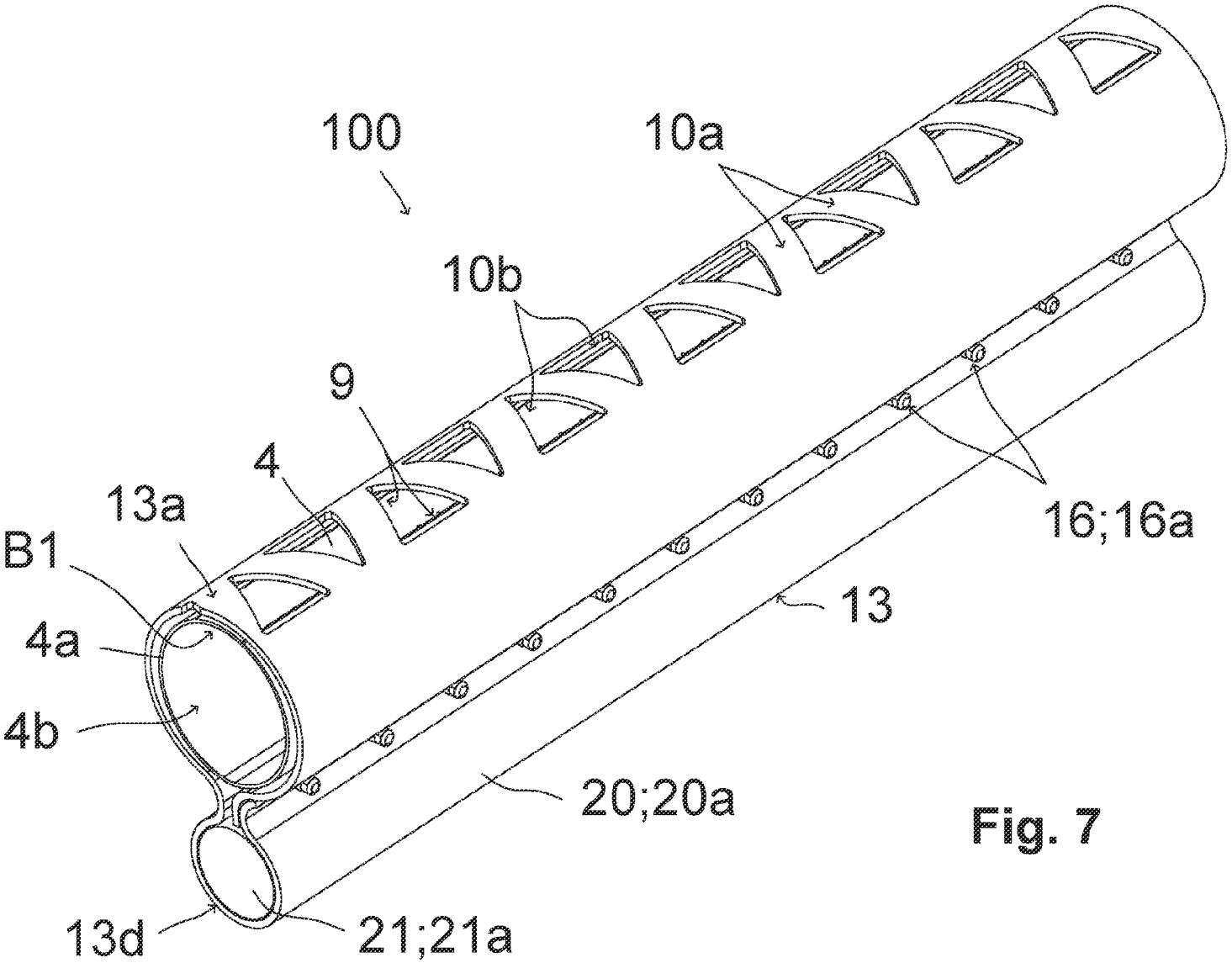

In the first embodiment according to the FIGS. 2 through 5, a web 12 is provided as support sheath 10 whose textile and/or mineral fibers form the material bars 10*a* which are interconnected at intersecting points 10*c* so that regular openings 10*b* (meshes) are created in-between the material bars 10*a*. As an alternative, the second embodiment according to the FIGS. 6, 7 and 8 provides that the support sheath 10 is formed by a first partial area 13*a* of a fabric layer reinforced polymer band 13 made of a rubber or a comparable polymer material. In this embodiment example, the material bars 10*a* and the openings 10*b* are created by cutting out the polymer band 13 in certain areas. By way of examples, two different shapes of the cut-out openings 10*b* or, respectively, the remaining material bars 10*a* are shown in FIG. 6 or FIG. 7. Alternatively, the material bars 10*a* in this embodiment may be made separately, whereby they preferably comprise the same or a similar elastic material as the polymer band 13 and are joined to the polymer band at their ends, for example, by riveting or adhesive bonding, so that the openings 10*b* are created in-between. In that case, the polymer band 13 is designed in this first partial area 13*a* as multi-piece.

On the underside the hose arrangement 100 in both embodiment examples comprises a ballast receptacle 20 for a ballast element 21 also extending in the longitudinal direction X by means of which the hose arrangement 100 can be secured at the bottom of the sea 3. Preferably, a connection between the air hose 4 and the ballast receptacle 20 is attained merely via the support sheath 10 so that the air hose 4 itself does not require additional extensive thermal and/or chemical and/or mechanical treatment. Merely by way of support, at certain points, e.g., at the ends and at selected intermediate positions, an additional adhesive connection may be provided, e.g. via a PU adhesive, between the support sheath 10 and the air hose 4 so as to avoid slipping or twisting of the air hose 4 within the support sheath 10. In addition or as an alternative hereto, at certain points a frictional and/or positive locking connection may be provided between the support sheath 10 and the air hose 4, for example, by means of a clamping connection or a rivet connection, for example, via a pop rivet penetrating the support sheath 10 and the air hose 4.

In FIG. 3, the hose arrangement 100 with the web 12 as support sheath 10 is shown by dotted lines in a state in which no pressurized air is applied to the air hose 4, whereby the air hose 4, in particular, caused by the water pressure prevailing in the environment U, is pushed flat, whereby the web 12 is able to follow this movement (not shown for greater clarity). According to the representation in FIG. 3 with full lines, pressurized air is applied to an interior 4*b* of the air hose 4, whereupon the air hose 4 expands and assumes a round shape or an oval shape. The air hose 4 of the hose arrangement 100 with the polymer band 13 as support sheath 10 also acts in a similar manner in the non-pressurized or, respectively, pressurized state.

To that end, according to FIG. 2 or 5, a perforation 9 is introduced into the wall 4*a* of the air hose 4 at the upper side along the ridge line, for example, by punching. Such perforation 9 is preferably made from finest slit-shaped or point-type punctures 9*a* which are designed such that they can open automatically, in the event of certain pressure relations prevailing in the interior 4*b*, to a certain opening width of between 1 mm and 3 mm. Hereby, in a way, they act as valves so that the air under pressure can be discharged in fine bubbles from the interior 4*b* via the plurality of punctures 9*a* into the environment U so as to create a bubble curtain BC, as indicated merely schematically in FIG. 5. When the pressurized air is switched off or, respectively, in the non-pressurized state the punctures 9*a* of the perforation 9 close automatically thereby preventing surrounding water from entering, and the environmental water pressure pushes the air hose 4 flat again (see FIG. 3 (dotted line).

Hereby, the punctures 9*a* or the perforation 9 are or, respectively, is introduced into the wall 4*a* in a first circumferential area B1 (see FIG. 4) arranged at the upper side in the area of the ridge line, while the wall 4*a* remains unperforated in a second circumferential area B2. In the first circumferential area B1 the punctures 9*a* are distributed evenly in the wall 4*a* along the longitudinal direction X, whereby end regions 4*c* (see FIG. 5) of the air hose 4 remain unperforated for sealing at the end. Typically, this allows one to twenty finest punctures 9*a* pro $cm^2$ to be made in the wall 4*a* of the air hose 4 so as to form a bubble curtain BC bubbling up evenly in the longitudinal direction X.

The opening width or, respectively, the size of the individual punctures 9*a* may also vary in the longitudinal direction X of the air hose 4, for example, to compensate for pressure drops caused by interior friction of the compressed air, for example, due to larger opening widths of the punctures 9*a*, towards the end of the air hose 4. Thus, the air hose 4 may even be composed of partial areas having differing puncture sizes or, respectively, opening widths. In that case the perforation 9 is will be designed such that the compressed air may still bubble up via the air hose 4 (in the longitudinal direction X) evenly even under varying water pressure levels in the environment U caused by differences in level of the bottom of the sea 3.

The respective support sheath 10 surrounds the air hose 4 both in the first circumferential area B1 and the second circumferential area B2, whereby, due to the openings 10*b* (punch-outs or meshes) in the support sheath 10, the above-described discharging of the air bubbles in the first circumferential area B1 will not be significantly affected. To that end, the openings 10*b* are preferably positioned in the support sheath 10 such that the air hose 4 will be exposed extensively, at least in the first circumferential area B1, and the material bars 10*a* cover merely smaller areas of the air hose 4 of the perforation 9 respectively, so that the creation of a bubble curtain BC will not be noticeably affected.

While the punch-outs (openings 10*b*) in the polymer band 13 of the second embodiment example according to FIGS. 6, 7 and 8 are determined accordingly such that they allow air bubbles to be discharged from the punctures 9*a* or the perforation 9 respectively, the second circumferential area 132 of the air hose 4 remains covered by the polymer band 13. This allows, at the same time, this second circumferential area B2 of the air hose 4 to be protected by the fabric layer reinforced polymer band 13 in order to prevent damage, in particular, during transport of the hose arrangement 100 and/or upon installation at the bottom of the sea 3. Thus, the polymer band 13 has a dual function (affixing the air hose 4 to the ballast receptacle 20 and protecting the air hose 4 against external influences).

The transition between the support sheath 10 and the ballast receptacle 20 will vary depending on the embodiment. In the first embodiment according to the FIGS. 2 through 5, the two lower ends 14*a*, 14*b* of the web 12 designed as support sheath 10 converge in a lower crown area S of the wall 4*a* and are detachably connected to the ballast receptacle 20 in a connecting area 15 across the entire longitudinal length. In this embodiment, the ballast receptacle 20 is formed by an elastically deformable, plate-shaped element 20*a* (or band-shaped, respectively, similar to the polymer band 13) made from a rubber material or a similar polymer material, where the plate-shaped element 20*a* with its edge regions 20*b* is folded or bent respectively loop-like back onto itself in the longitudinal direction so that a hose shape extending in the longitudinal direction X with a receiving area 8 is created. In this receiving area 8 a ballast element 21 extending in the longitudinal direction X is received, for example a steel cable or a steel rope 21*a* or a chain, serving as a weight for the hose arrangement 100 across its entire longitudinal length thereby securing it at the bottom of the sea.

The edge areas 20*b* of the folded-back element 20*a* enclose between them the lower ends 14*a*, 14*b* of the web 12 in the connecting area 15 essentially across the entire length L of the air hose 4. For mutual detachable attachment a connector means 16 is provided which, in this case, is formed by a screw connection 16*a*, the screws are inserted through connection holes 18 in the edge areas 20*b* as well as through the openings 10*b* or meshes respectively of the web 12. This makes the lower ends 14*a*, 14*b* of the web 12 become jammed in-between the edge areas 20*b* and also prevents the web 12 from being pulled off from the edge areas 20*b* due to the mesh-type structure of the web 12. Alternatively, a similar connection via pins or rivets or pilot bolts 16*c* (see FIG. 4) may be provided, where the connecting holes 18, when pilot bolts 16*c* with sharpened ends at the tip are utilized, in the edge areas 20*b* may be formed upon introduction of the pilot bolts 16*c* themselves, thereby simplifying the assembly process. However, instead, a rope-type or a band-type connector means 16*b* (s. FIG. 5) may be provided for a detachable connection, for example, a cord, a thread or a rope, made of a textile or metallic material, threaded through the connection holes 18 in the edge areas 20*b* of the plate-shaped element 20*a* and through the included openings 10*b* or, respectively, meshes in the web 12, thereby guaranteeing a mutual connection.

Both in case of a screw connection 16*a* and a rope-shaped or band-shaped connector means 16*b* it is possible to detach the connection between the two in a simple manner. This simplifies the assembly and disassembly or, respectively, a replacement of individual components of the hose arrangement 100, for example, in case of a defect of the respective component of the hose arrangement 100.

In the second embodiment according to the FIGS. 6, 7 and 8, the transition between the support sheath 10 and the ballast receptacle 20 happens in a one-piece design. To that end, as shown in FIGS. 6 and 7, the polymer band 13 is provided with the punched-out openings 10*b* in the first partial area 13*a*, the first partial area 13*a* being bordered by connection holes 18 in an upper first edge area 13*b* and a middle area 13*c* (see FIG. 8). A second partial area 13*d* is bordered by the connection holes 18 in the middle area 13*c* and by further connection holes 18 in a second edge area 13*e*. By suitably rolling up or folding over or folding back over itself respectively of the polymer band 13 along its longitudinal axis, it is possible to receive the air hose 4 in a space formed by the first partial area 13*a* and to receive the ballast element 21 in a receiving area 8 formed by the second partial area 13*d*. This shape can be maintained in that suitable connector means 16 (screw connection 16*a* or rope-shaped or band-shaped connector means 16*b* or rivets or pins) are introduced in the connection holes 18 lying aligned flush in the connecting area 15, where, then, the punched-out openings 10*b* lie accordingly above the perforation 9 of the air hose 4, as represented in FIGS. 6 and 7. This overall simplifies the making of the hose arrangement 100. When pilot bolts 16*c* with sharpened ends at the tip are utilized as connector means 16, the connection holes 18 may even be formed directly upon introduction of the pilot bolts 16*c* themselves.

In principle, the polymer band 13 may also be designed in two pieces, where, then, a separation into two partial bands happens in the middle area 13*c*. The two partial bands or, respectively, partial areas 13*a*, 13*d* which, then, each comprise connection holes 18 at the edges, will then be joined in the connecting the area 15 by suitable connector means 16 via the connection holes 18, in a manner similar to the first embodiment.

In all embodiments described here, the hose arrangement 100 may consist of a plurality of air hoses 4 in segments joined via a hose coupling (not shown). Thereby, a hose arrangement 100 can be provided consisting of a plurality of air hoses 4 joined in segments. Hereby, it may be provided for the support sheath 10 to extend across the hose coupling and/or being clamped in jointly with the hose coupling so as to prevent slippage of the air hose 4 in relation to the support sheath 10.

LIST OF REFERENCE NUMERALS

1 pole
2 hammering device
3 bottom of the sea
4 air hose
4*a* wall of the air hose 4
4*b* interior of the air hose 4
4*c* end region of the air hose 4
5 supply vessel
6 winding winch
7 compressor
8 receiving area
9 perforation
9*a* puncture
10 support sheath
10*a* material bars
10*b* openings
10*c* intersecting points
12 web
13 polymer band
13*a* first partial area
13*b* first edge are of the polymer band 13
13*c* middle area of the polymer band 13
13*d* second partial area of the polymer band 13
13*e* second edge area of the polymer band 13
14*a*, 14*b* lower ends of the web 12
15 connecting area
16 connector means

16*a* screw connection
16*b* rope-type or band-type connector means
16*c* pilot bolt
18 connection holes
20 ballast receptacle
20*a* panel-shaped element
20*b* edge areas of the panel-shaped element 20*a*
21 ballast element
21*a* steel cable
100 hose arrangement
B1 first circumferential area of the wall 4*a*
B2 second circumferential area of the wall 4*a*
BC bubble curtain
L length of the air hose 4
lower crown area of the wall 4*a*
U environment
X longitudinal direction

The invention claimed is:

1. A hose arrangement for creating a bubble curtain in bodies of water, the hose arrangement comprising an air hose including a wall defining an interior space, wherein the wall further defines a plurality of punctures at least in an upper, first circumferential area of the wall relative to a longitudinal direction of the hose arrangement from which air can be discharged when the interior space is pressurized so that a bubble curtain extending in the longitudinal direction of the air hose is created, and a ballast receptacle defining a receiving area extending in the longitudinal direction of the hose arrangement and an elongated ballast element adapted to be received in the ballast receptacle in the receiving area, and a support sheath adapted to jacket at least the air hose, the support sheath including a plurality of material bars defining a plurality of intermediate openings, the plurality of intermediate openings being positioned at least at the first circumferential area of the air hose so as to allow air to be discharged from the plurality of punctures of the air hose through the plurality of intermediate openings.

2. The hose arrangement of claim 1, wherein the support sheath couples the air hose to the ballast receptacle in a connecting area of the ballast receptacle.

3. The hose arrangement of claim 1, wherein the air hose is connected to the ballast receptacle exclusively via the support sheath.

4. The hose arrangement of claim 1, wherein the support sheath jackets at least 75% of the length of the air hose.

5. The hose arrangement of claim 4, wherein the support sheath jackets the entire length of the air hose.

6. The hose arrangement of claim 2, wherein the plurality of material bars of the support sheath is formed by a web of interconnected fibers defining the plurality of intermediate openings so that the plurality of intermediate openings are mesh-type openings.

7. The hose arrangement of claim 6, wherein the web of interconnected fibers are textile or mineral fibers.

8. The hose arrangement of claim 6, wherein at least two ends of the support sheath are affixed to the connecting area of the ballast receptacle.

9. The hose arrangement of claim 8, wherein the at least two ends of the support sheath are clamped to the connecting area of the ballast receptacle.

10. The hose arrangement of claim 1, wherein the support sheath is formed from a polymer band, wherein the polymer band includes a first partial area having the plurality of material bars, the plurality of material bars defining the plurality of intermediate openings which are positioned at least at the first circumferential area of the air hose so as to allow air to be discharged from the plurality of punctures of the air hose through the plurality of intermediate openings.

11. The hose arrangement of claim 10, wherein the material bars are formed from the polymer band.

12. The hose arrangement of claim 10, wherein the material bars are coupled to the polymer band by riveting or adhesive bonding.

13. The hose arrangement of claim 10, wherein the air hose includes a second circumferential area, and wherein the first partial area of the polymer fully covers the second circumferential area of the air hose.

14. The hose arrangement of claim 10, wherein the ballast receptacle is formed by a second partial area of the polymer to receive the ballast element, the first partial area and the second partial area being formed from the polymer band so that the polymer band is a single piece.

15. The hose arrangement of claim 10, wherein at least the first partial area of the polymer band is made from a fabric layer reinforced polymer.

16. The hose arrangement of claim 1, wherein the ballast receptacle is formed by a deformable, panel-shaped element, wherein deformable, panel-shaped element includes two edge regions which are folded loop-like back onto themselves such that a hose shape defining the receiving area extending in the longitudinal direction is created, in which the ballast element is received, wherein the two edge regions of the panel-shaped element are connected in a connecting area to the support sheath.

17. The hose arrangement of claim 16, wherein connector means are arranged between the support sheath and the ballast receptacle.

18. The hose arrangement of claim 17, wherein the connector means are a screw connection, rope-type connector means, band-type connector means, nails, rivets, or pilot bolts.

19. The hose arrangement of claim 1, wherein the support sheath lies fully in loose contact with the air hose.

20. The hose arrangement of claim 1, wherein the support sheath is connected to the air hose via a substance-to-substance bond, via a PU adhesive, a clamp or a rivet connection.

* * * * *